US012472415B1

(12) United States Patent
Williamson

(10) Patent No.: US 12,472,415 B1
(45) Date of Patent: Nov. 18, 2025

(54) GOLF PUTT TRAINING AID

(71) Applicant: Richard Williamson, Las Vegas, NV (US)

(72) Inventor: Richard Williamson, Las Vegas, NV (US)

( * ) Notice: Subject to any disclaimer, the term of this patent is extended or adjusted under 35 U.S.C. 154(b) by 328 days.

(21) Appl. No.: 18/242,854

(22) Filed: Sep. 6, 2023

Related U.S. Application Data

(60) Provisional application No. 63/403,963, filed on Sep. 6, 2022.

(51) Int. Cl.
*A63B 69/36* (2006.01)

(52) U.S. Cl.
CPC ..... *A63B 69/3608* (2013.01)

(58) Field of Classification Search
CPC ..... A63B 69/3608
USPC ..... 473/205–209, 212, 219–225, 257, 266, 473/267, 274, 276, 278
See application file for complete search history.

(56) References Cited

U.S. PATENT DOCUMENTS

| | | | | |
|---|---|---|---|---|
| 3,109,244 | A * | 11/1963 | Trifaro | A63B 69/0057 473/409 |
| 3,820,781 | A * | 6/1974 | Kane | A63B 23/0211 473/409 |
| 5,890,968 | A * | 4/1999 | Mingo | A63B 69/0059 473/212 |
| 7,869,102 | B2 * | 1/2011 | Ohara | H04N 1/1017 358/461 |
| 2004/0087391 | A1 * | 5/2004 | Stauber | A63B 69/3608 473/422 |

* cited by examiner

*Primary Examiner* — Nini F Legesse
(74) *Attorney, Agent, or Firm* — QuickPatents; Kevin Prince

(57) ABSTRACT

A putt training aid for use by a golfer in a doorway includes a back bar having two opposing ends and at least two arm receiving apertures therethrough. Two rollers each extend away from one of the two opposing ends of the back bar. Two support arms each include a proximal end fixable with one of the arm receiving apertures of the back bar, and a distal end that is preferably curved upwardly to engage the golfer under his arms. In use, with each support arm fixed under one of the arms of the golfer, and with the back bar positioned across a back of the golfer, the golfer stands in a putting position in the doorway with the rollers each contacting one of the sides of the doorway to maintain a putter in a single plane during a putting stroke.

11 Claims, 8 Drawing Sheets

GOLF PUTT TRAINING AID

CROSS REFERENCE TO RELATED APPLICATIONS

This application claims the benefit of U.S. Provisional Patent Application 63/403,963, filed on Sep. 6, 2022, and incorporated herein by reference.

STATEMENT REGARDING FEDERALLY SPONSORED RESEARCH AND DEVELOPMENT

Not Applicable.

FIELD OF THE INVENTION

This invention relates to the sport of golf, and more particularly to a golf putt training device.

BACKGROUND

In the game of golf, a proper putting stroke can make a large difference in a golfer's score. While putting, many amateur golfers move their shoulders in a horizontal motion, with their arms moving out-of-synch with their shoulders. Moreover, the shoulders of the golfer should be in alignment with the golfer's feet during a putting stroke. Without proper training a beginning golfer can adopt an improper putting stroke that is difficult to change later.

Therefore, there is a need for a putt training aid that will force the golfer's shoulders to rotate in a vertical motion, moving their shoulders up and down vertically, without any horizontal motion. Such an invention would promote the arms and shoulders moving together during the putting stroke, and would promote proper alignment between the shoulders and the feet of the golfer. Such a needed invention would further be easy to set-up and use, and would be collapsible for easy storage and transport. The present invention accomplishes these objectives.

SUMMARY OF THE INVENTION

The present device is a putt training aid for use by a golfer in a doorway, or the like. The putt training aid takes advantage of the doorway having two opposing vertical sides that are aligned in the same plane.

A back bar comprises two opposing ends, as well as at least two arm receiving apertures therethrough. In some embodiments, the back bar includes an internal bar and an external bar mutually telescopingly engaged, such that a length of the back bar can be adjusted to fit the golfer. In other embodiments, the back bar is one piece with a non-circular cross-section.

Two opposing rollers each extend away from one of the two opposing ends of the back bar. Each roller comprises an outer rolling surface and an inner stationary member. The outer rolling surface is free to rotate about a longitudinal axis of the roller.

Two support arms each include a proximal end fixable with one of the arm receiving apertures of the back bar, and a distal end that is preferably curved upwardly to engage the golfer under his arms. In some embodiments each support arm is oval-shaped or even relatively flat, and coated with a pliable outer layer for comfort. A length of each support arm may be adjustable with respect to the back bar to provide a custom fit to the golfer. In use, with each support arm fixed under one of the arms of the golfer, and with the back bar positioned across a back of the golfer, the golfer stands in a putting position in the doorway with the rollers each contacting one of the sides of the doorway to prevent the golfer from moving out of a plane of the doorway. The golfer then practices a putting stroke while allowing the rollers to roll along the sides of the doorway, always making contact therewith for proper form and so that a putter is maintained in a single plane during the putting stroke.

Some embodiments of the invention may further include a harness wearable by the golfer and adapted for receiving the back bar attached thereto at a back side thereof. As such, the back bar may be supported on the golfer by the harness, so that the golfer does not have to support the back bar himself by clamping his arms against the support arms of the putt training aid.

The present invention is a putt training aid that forces the golfer's shoulders to rotate in a vertical motion, with the golfer moving his shoulders up and down vertically without any significant horizontal motion. The present device promotes the arms and shoulders moving together during the putting stroke, and promotes proper alignment between the shoulders and the feet of the golfer. The present invention is relatively easy to set-up and use, and can be collapsed for easy storage and transport. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4 illustrate a putt training aid 10 for use by a golfer 20 in a doorway 15, or the like. The putt training aid 10 takes advantage of the doorway 15 having two opposing vertical sides 16 that are aligned in the same plane. For purposes of this disclosure, the doorway 15 can be any structure having two opposing vertical sides 16, and does not have to be a doorway per se. For example, two vertical, parallel posts (not shown) projecting upwardly or on an angle can serve as the doorway 15.

Figure 7:
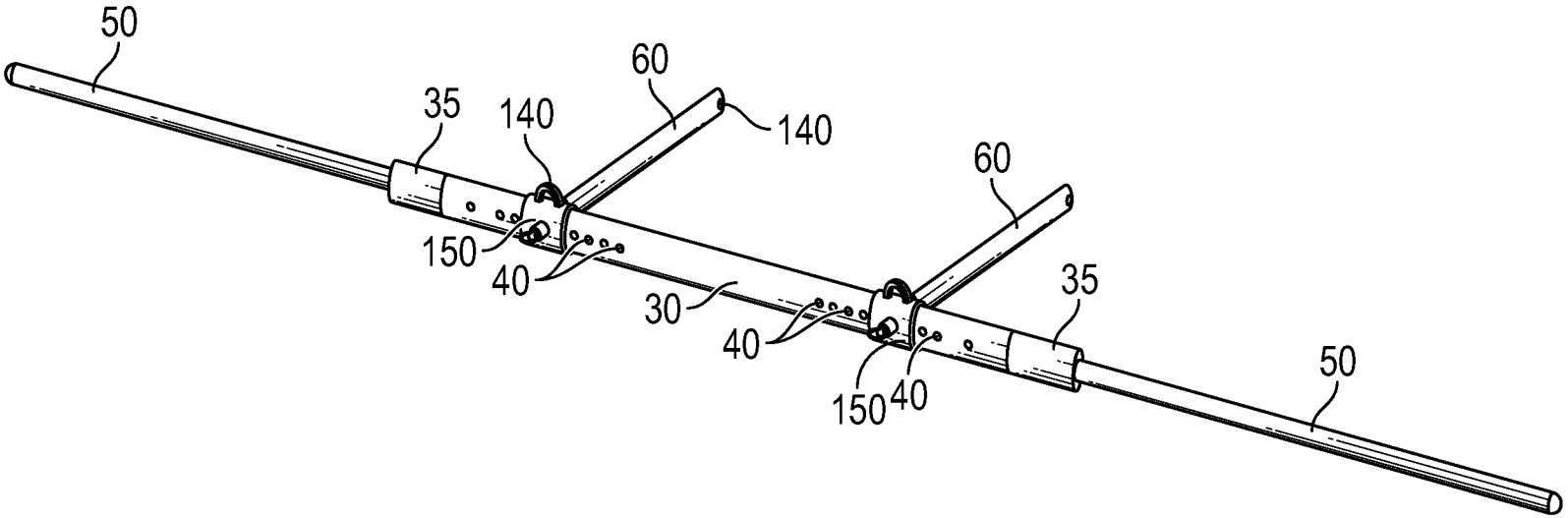
FIG. 7 is a rear perspective view of an alternate embodiment of the back bar and support arms of the invention.
Figure 8:
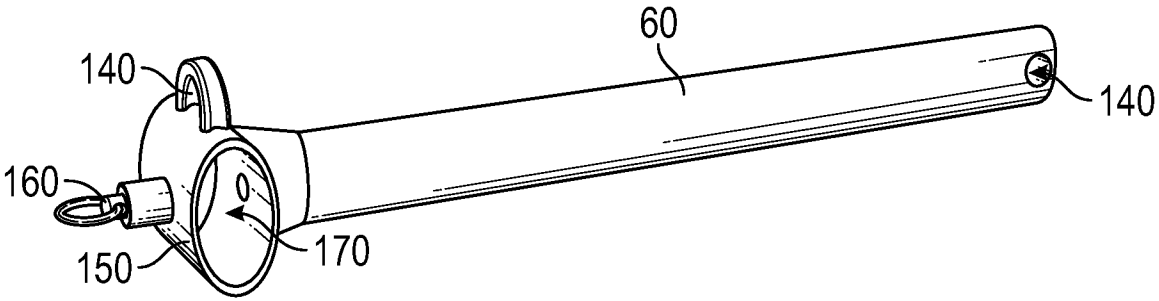
FIG. 8 is an enlarged perspective view of one of the support arms of the embodiment of FIG. 7.
Figure 9:
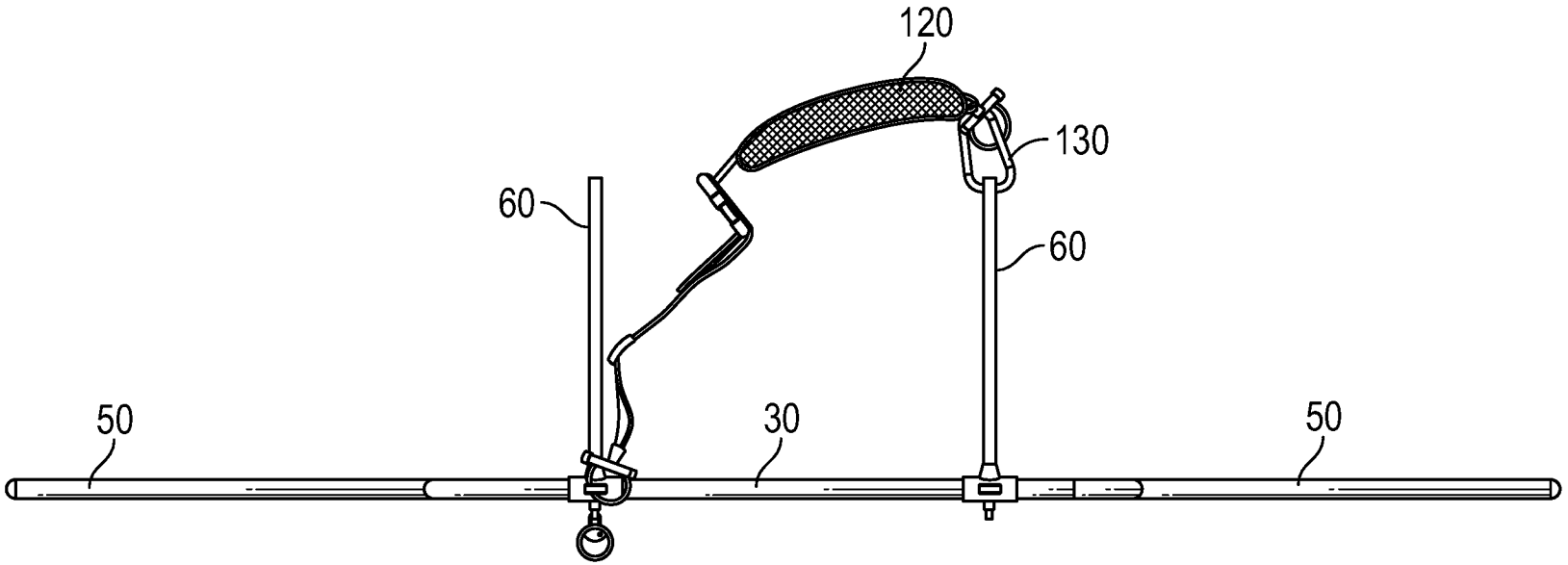
FIG. 9 is a top plan view of an alternate embodiment of the harness.

A back bar 30 comprises two opposing ends 35, as well as at least two arm receiving apertures 40 therethrough. In some embodiments, the back bar 30 includes an internal bar 70 and an external bar 80 mutually telescopingly engaged, such that a length of the back bar 30 can be adjusted to fit the golfer 20. In such an embodiment, the internal bar 70 may include external notches 90 on one side 73 thereof, while the external bar 80 includes a spring-biased latch 100 adapted to engage any of the notches 90. The internal bar 70 is free to move telescopically with respect to the external bar 80 when the spring-biased latch 100 is actuated, but otherwise the spring-biased latch 100 engages one of the notches 90 to lock the internal bar 70 to the external bar 80. In alternate embodiments, the back bar is non-circular in cross-section (FIGS. 7-9).

Two opposing rollers 50 each extend away from one of the two opposing ends 35 of the back bar 30. Each roller 50 comprises an outer rolling surface 58 and an inner stationary member 52. The outer rolling surface 58 is free to rotate about a longitudinal axis L 8 (FIG. 4) of the roller 50. The outer rolling surface 58 may include an end cap 59. Ball bearings (not shown), or smooth low-friction surfaces (not shown) between the outer rolling surface 58 and the inner stationary member 52 may be included to facilitate free rotation of the outer rolling surface 58 with respect to the inner stationary member 52.

Two support arms 60 each include a proximal end 62 fixable with one of the arm receiving apertures 40 of the back bar 30, and a distal end 68 that, in some embodiments, is curved upwardly to engage the golfer 20 under his arms 23. In some embodiments each support arm 60 is oval-shaped or even relatively flat, and coated with a pliable outer layer 110 for comfort.

Each support arm 60 may include the external notches 90 on one side 63 thereof, while the back bar 30 includes at each arm receiving aperture 40 one of the spring-biased latches 100 adapted to engage any of the notches 90 of the support arm 60. The support arm 60 is free to move with respect to the back bar 30 when the spring-biased latch 100 is actuated, but otherwise the spring-biased latch 100 engages one of the notches 90 to lock the support arm 60 to the back bar 30.

In some embodiments the spring-biased latch 100 on the external bar 80 for engaging the internal bar 70 is substantially identical to the spring-biased latches 100 on the back bar 30 for engaging each support arm 60, except taking into account that the support arms 60 are generally orthogonal to the back bar 30 while the internal bar 70 and the external bar 80 are longitudinally aligned. As such, the spring-biased latch 100 on the external bar 80 for engaging the internal bar 70 must be able to engage the notches 90 on the internal bar in a different direction that does the spring-biased latch 100 on the back bar 30 for engaging one of the support arms 60. Nevertheless, in other aspects the spring-biased latches 100 may be essentially identical in attributes such as size, color, and general shape.

In use, with each support arm 60 fixed under one of the arms 23 of the golfer 20, and with the back bar 30 positioned across a back 25 (FIG. 6) of the golfer 20, the golfer 20 stands in a putting position 17 in the doorway 15 with the rollers 50 each contacting one of the sides 16 of the doorway 15 to prevent the golfer 20 from moving out of a plane of the doorway 15. The golfer 20 then practices a putting stroke while allowing the rollers to roll along the sides 16 of the doorway 15, always making contact therewith for proper form.

Figure 1:
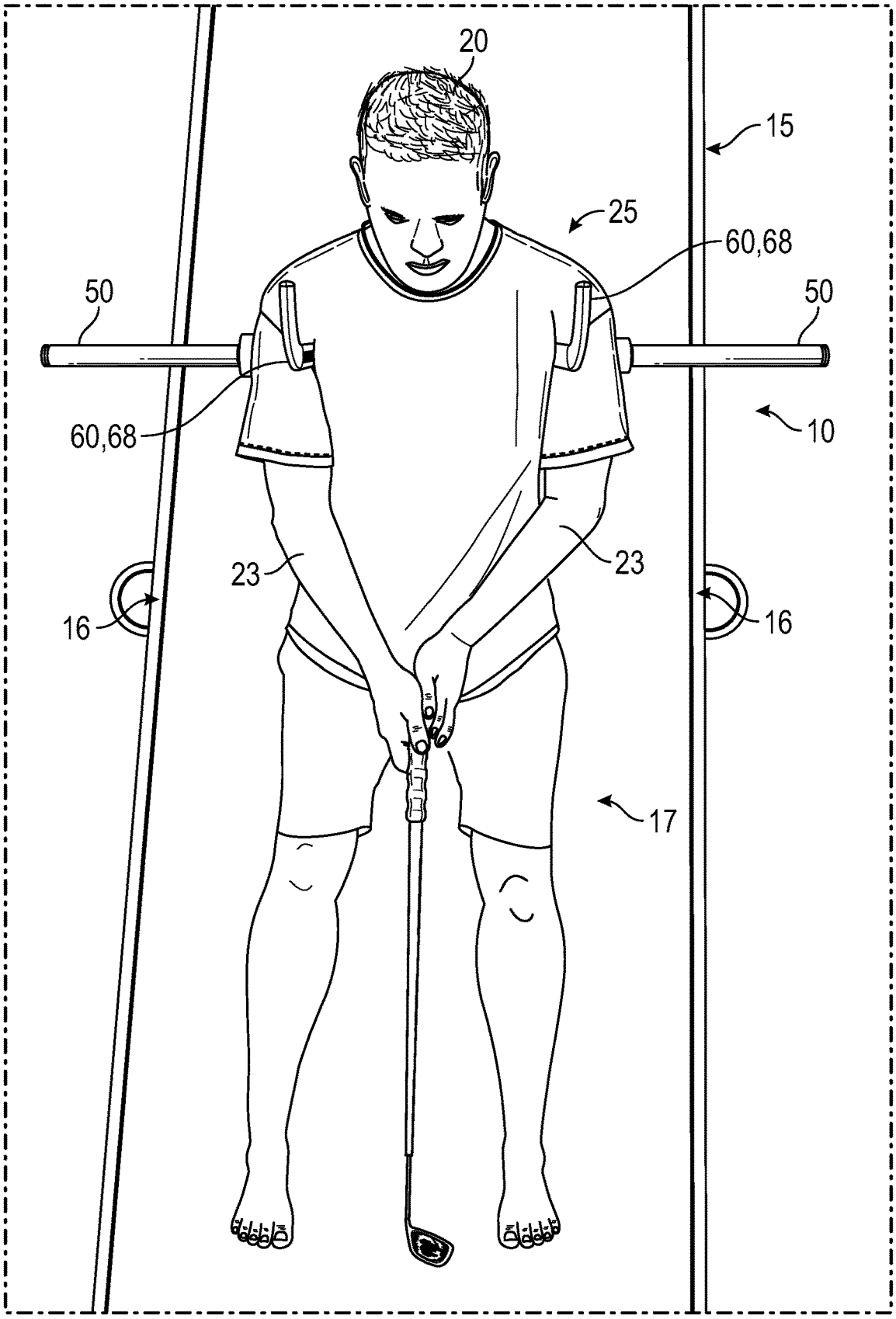
FIG. 1 is a front elevational view of the invention, illustrated in-use by a golfer in a doorway.
Figure 2:
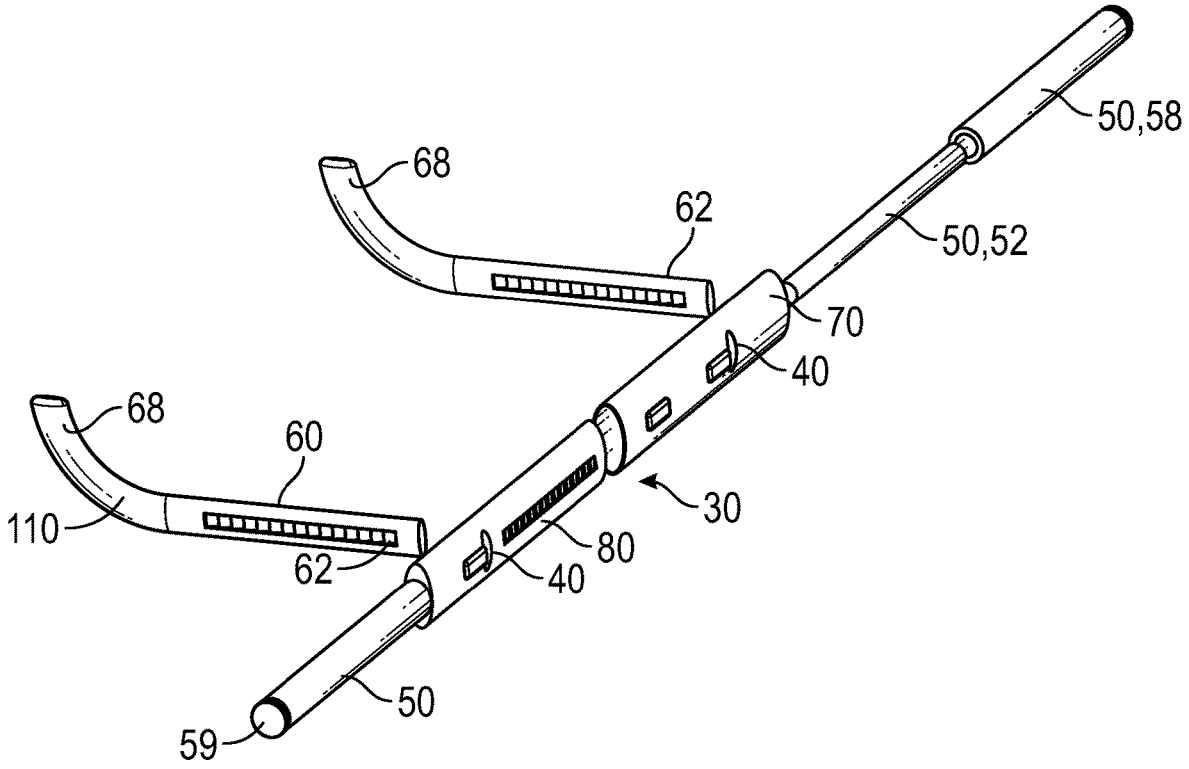
FIG. 2 is an exploded rear perspective view of the invention.
Figure 3:
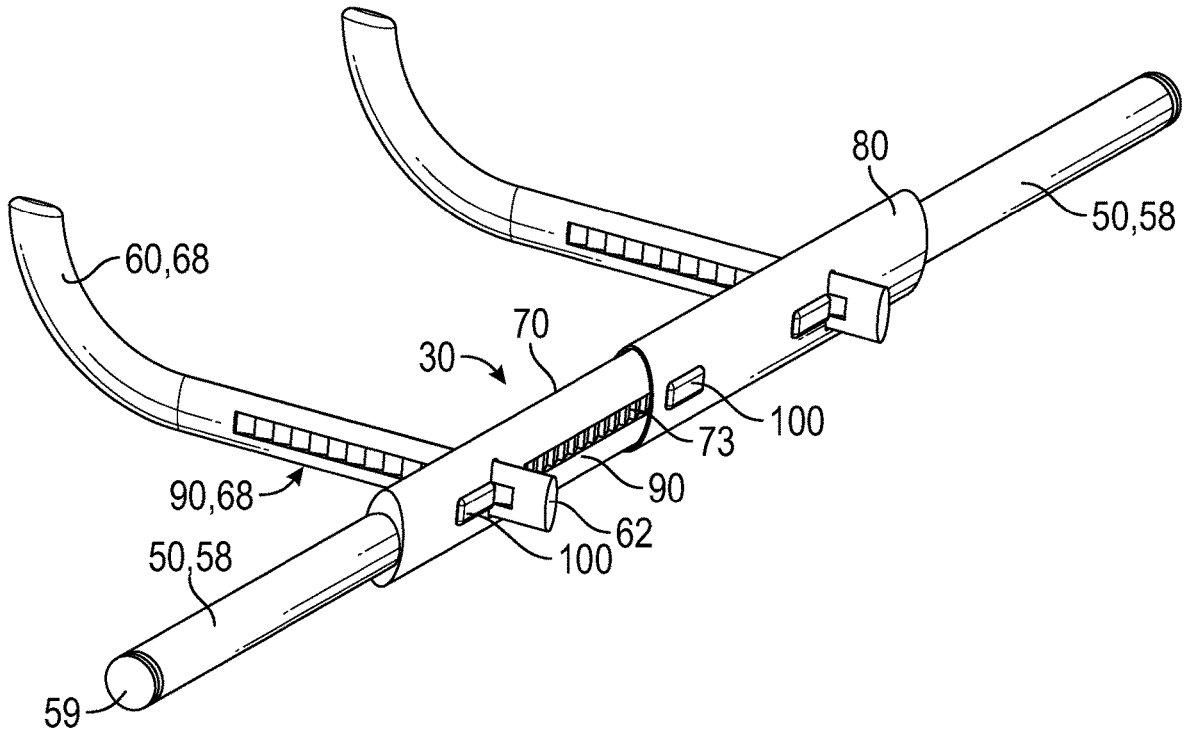
FIG. 3 is a rear perspective view of the invention.
Figure 4:
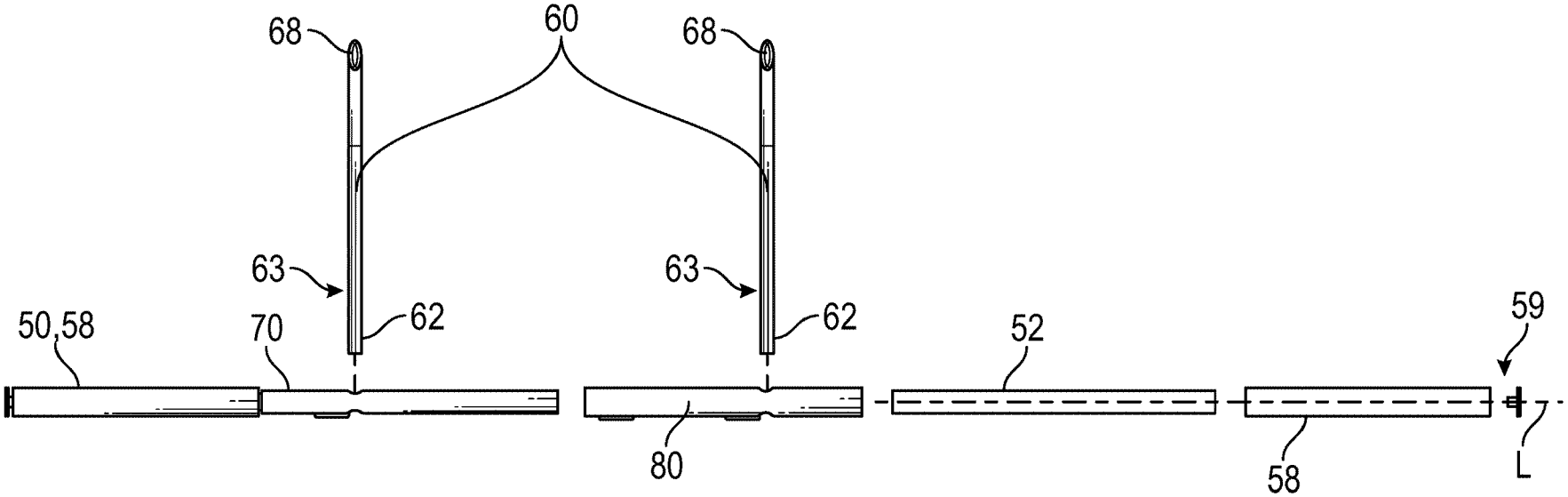
FIG. 4 is an exploded top plan view of the invention.
Figure 5:
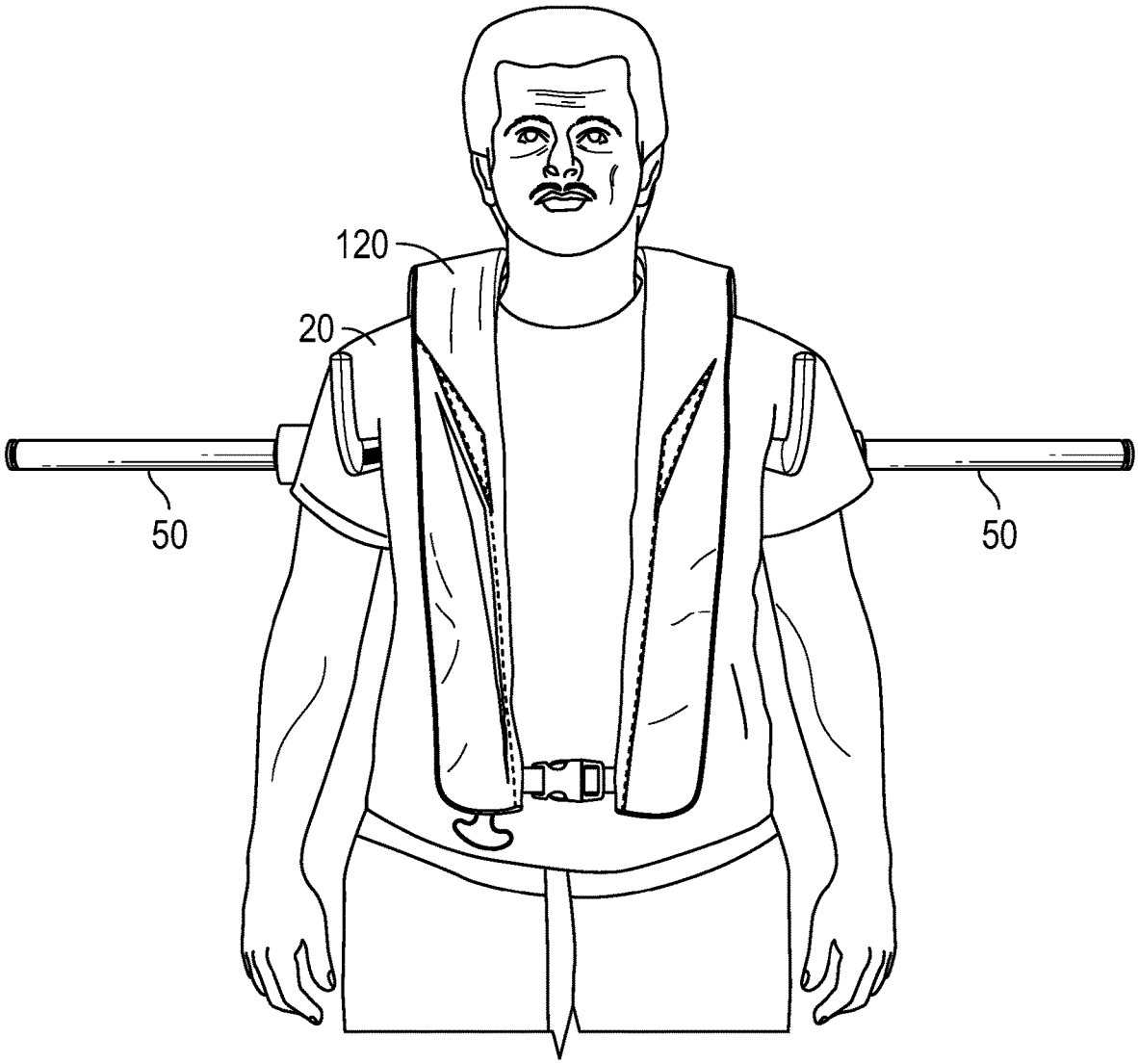
FIG. 5 is a front elevational view of an alternate embodiment of the invention that includes a harness.
Figure 6:
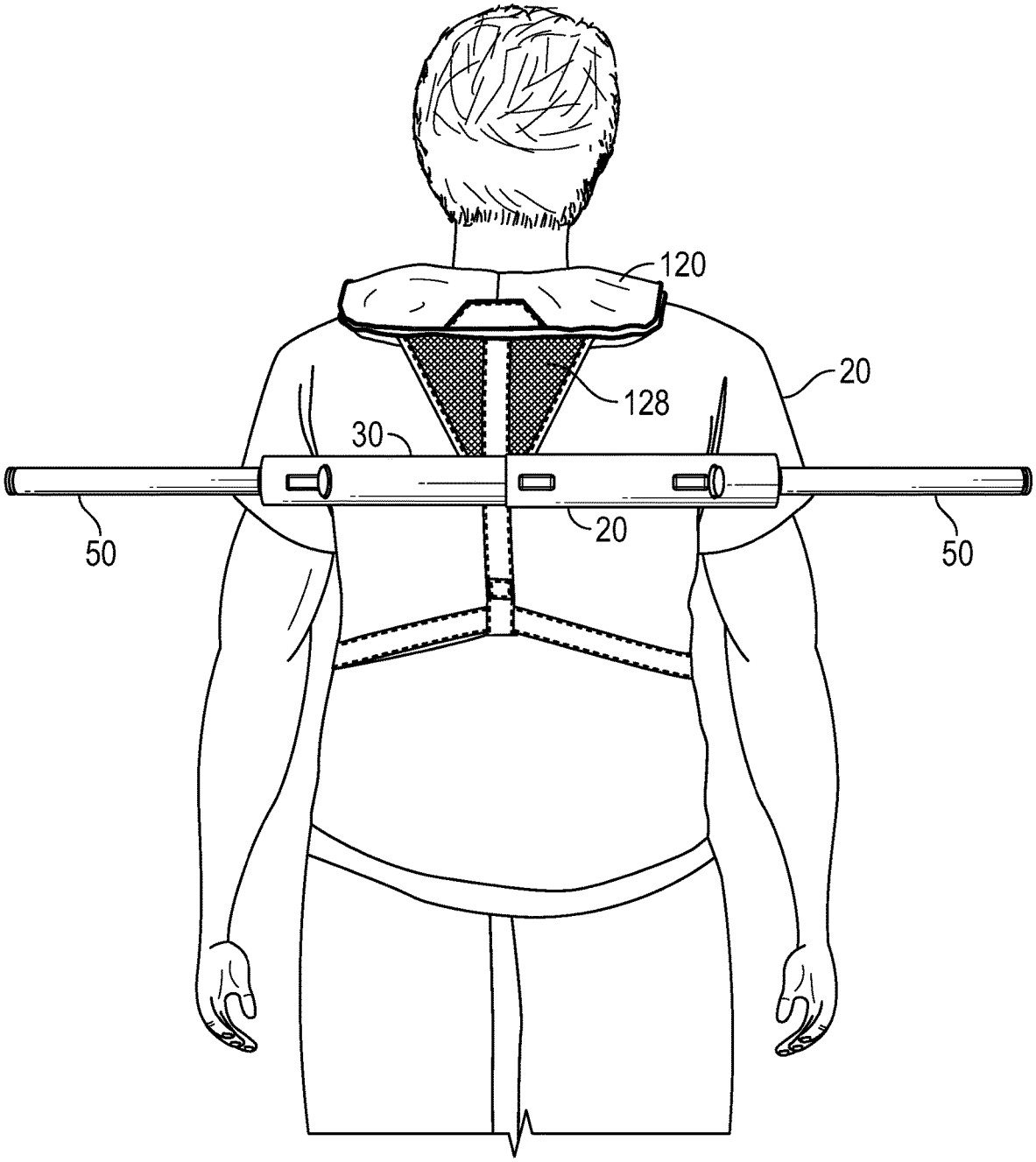
FIG. 6 is a rear elevational view of the embodiment of FIG. 5.

Some embodiments of the invention may further include a harness 120 (FIGS. 5 and 6) wearable by the golfer 20 and adapted for receiving the back bar 30 attached thereto at a back side 128 thereof. As such, the back bar 30 may be supported on the golfer 20 by the harness 120, so that the golfer 20 does not have to support the back bar 30 himself by clamping his arms 23 against the support arms 60 of the putt training aid 10. Such a harness 120 includes a flexible fabric or foam with support straps, as illustrated in FIGS. 5 and 6.

In some embodiments, each support arm 60 further includes a back bar engaging bracket (FIGS. 7 and 8) having an adjustment aperture 170 alignable with any of the arm receiving apertures 40 of the back bar 30, through which a pin 160, such as a spring-biased pin 160, is inserted to fix the support arm 60 with the back bar 30. The back bar engaging bracket 150 is shaped to slide along the non-circular back bar 30 to a proper position for the golfer 20, and then the pin 160 is inserted into the adjustment aperture and through one of the arm receiving apertures 40 of the back bar 30 to fix the position of the support arm 60 with the back bar 30. In such embodiments, the harness 120 may be fixed to harness apertures 140 at the distal ends 68 of the support arms 60 and/or at the back bar engaging bracket 150 (FIGS. 8 and 9).

While a particular form of the invention has been illustrated and described, it will be apparent that various modifications can be made without departing from the spirit and scope of the invention. For example, the shape of the back bar 30 and support arms 60 may vary, and the attachment means between the support arms 60 and the back bar 30 may also take various forms. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A putt training aid for use by a golfer in a doorway, comprising:

a back bar comprising two opposing ends, the back bar further including at least two arm receiving apertures at least partially therethrough;

a pair of rollers, each roller extending away from one of the two opposing ends of the back bar and comprising an outer rolling surface and an inner stationary member, the outer rolling surface free to rotate about a longitudinal axis of the roller; and a pair of support arms, each support arm having a proximal end fixable with one of the arm receiving apertures of the back bar;

whereby with each support arm fixed under an arm of the golfer, and with the back bar positioned across a back of the golfer, with the golfer standing in a putting position in the doorway, the rollers each contact a side of the doorway to prevent the golfer from moving out of a plane of the doorway while practicing a putting stroke.

2. The putt training aid of claim 1 wherein the back bar includes an internal bar and an external bar telescopingly engaged, such that a length of the back bar can be adjusted to fit the golfer.

3. The putt training aid of claim 2 wherein the internal bar includes external notches on one side thereof, and wherein the external bar includes a spring-biased latch adapted to engage any of the notches, the internal bar free to move with respect to the external bar when the spring-biased latch is actuated.

4. The putt training aid of claim 1 wherein each support arm includes external notches on one side thereof, and wherein the back bar includes a spring-biased latch proximate each arm receiving aperture and adapted to engage any of the notches of the support arm, each support arm free to move with respect to the back bar when the spring-biased latch is actuated.

5. The putt training aid of claim 1 wherein each support arm curves upwardly at a distal end thereof.

6. The putt training aid of claim 5 wherein each support arm is relatively flat and coated with a pliable outer layer.

7. The putt training aid of claim 1 further including a harness wearable by the golfer and that is adapted for receiving the back bar attached thereto at a back side thereof.

8. The putt training aid of claim 1 wherein the back bar is non-circular in cross-section, and wherein each support arm further includes a back bar engaging bracket having an adjustment aperture alignable with any of the arm receiving apertures of the back bar, through which a pin is inserted to fix the support arm with the back bar.

9. The putt training aid of claim 8 wherein the pin is a spring-biased pin.

10. A putt training aid for use by a golfer in a doorway, comprising:

a back bar comprising two opposing ends, the back bar further including at least two arm receiving apertures at least partially therethrough, the back bar including an internal bar and an external bar telescopingly engaged, such that a length of the back bar can be adjusted to fit the golfer;

a pair of rollers, each roller extending away from one of the two opposing ends of the back bar and comprising an outer rolling surface and an inner stationary member, the outer rolling surface free to rotate about a longitudinal axis of the roller;

a pair of support arms, each support arm having a proximal end fixable with one of the arm receiving apertures of the back bar, each support arm including external notches on one side thereof, and wherein the back bar includes a spring-biased latch proximate each arm receiving aperture and adapted to engage any of the notches of the support arm, each support arm free to move with respect to the back bar when the spring-biased latch is actuated, each support arm being relatively flat and coated with a pliable outer layer; and a harness wearable by the golfer and that is adapted for receiving the back bar attached thereto at a back side thereof;

wherein the internal bar includes external notches on one side thereof, and wherein the external bar includes a spring-biased latch adapted to engage any of the notches, the internal bar free to move with respect to the external bar when the spring-biased latch is actuated;

whereby with each support arm fixed under an arm of the golfer, and with the back bar positioned across a back of the golfer, with the golfer standing in a putting position in the doorway, the rollers each contact a side of the doorway to prevent the golfer from moving out of a plane of the doorway while practicing a putting stroke.

11. A putt training aid for use by a golfer in a doorway, comprising:

a back bar comprising two opposing ends, the back bar further including at least two arm receiving apertures at least partially therethrough, the back bar being non-circular in cross-section;

a pair of rollers, each roller extending away from one of the two opposing ends of the back bar and comprising an outer rolling surface and an inner stationary member, the outer rolling surface free to rotate about a longitudinal axis of the roller;

a pair of support arms, each support arm having a proximal end fixable with one of the arm receiving apertures of the back bar, each support arm further including a back bar engaging bracket having an adjustment aperture alignable with any of the arm receiving apertures of the back bar, through which a spring-biased pin is inserted to fix the support arm with the back bar, each support arm free to move with respect to the back bar when the spring-biased pin is pulled away from the back bar; and a harness wearable by the golfer and that is adapted for receiving the back bar attached thereto at a back side thereof;

whereby with each support arm fixed under an arm of the golfer, and with the back bar positioned across a back of the golfer, with the golfer standing in a putting position in the doorway, the rollers each contact a side of the doorway to prevent the golfer from moving out of a plane of the doorway while practicing a putting stroke.

* * * * *